United States Patent [19]

Schulz

[11] 4,240,475

[45] Dec. 23, 1980

[54] SAFETY MOUNTING DEVICE FOR THE NOZZLE OF A LIQUID-FUEL DISPENSING PUMP

[75] Inventor: Manfred Schulz, Einbeck, Fed. Rep. of Germany

[73] Assignee: Dresser Europe S.A., Einbeck, Fed. Rep. of Germany

[21] Appl. No.: 14,403

[22] Filed: Feb. 23, 1979

[30] Foreign Application Priority Data

Feb. 24, 1978 [DE] Fed. Rep. of Germany ..... 2807976

[51] Int. Cl.[3] ..... B65B 3/00; B05B 15/06

[52] U.S. Cl. ..... 141/392; 222/74; 222/75; 248/75

[58] Field of Search ..... 141/1, 97, 98, 286, 141/392; 222/74, 75, 131, 530; 248/75, 79, 80

[56] References Cited

U.S. PATENT DOCUMENTS

| | | | |
|---|---|---|---|
| 2,150,025 | 3/1939 | Cook, Jr. et al. | 222/75 X |
| 2,699,884 | 1/1955 | Foss et al. | 222/75 |

*Primary Examiner*—Frederick R. Schmidt

*Attorney, Agent, or Firm*—Allison C. Collard; Thomas M. Galgano

[57] ABSTRACT

A safety mounting device for a fuel-pump nozzle includes a vertical passage which attaches the nozzle receptacle to the pump casing. The major portion of the passage is located within, but sealed from the casing, but upper and lower vents open outside the casing to induce a throughflow of air which prevents any explosive gas mixtures from the nozzle from penetrating the casing. A closed or vented chamber may be provided between the receptacle and the passage.

7 Claims, 3 Drawing Figures

SAFETY MOUNTING DEVICE FOR THE NOZZLE OF A LIQUID-FUEL DISPENSING PUMP

BACKGROUND OF THE INVENTION

The present invention relates to a safety mounting device for the fuel-dispensing nozzle of a liquid-fuel-dispensing pump.

Liquid-fuel-dispensing pumps normally have a casing partitioned into a lower part containing the pump and other fuel-conveying elements and an upper part containing the switching mechanism and electrical circuitry for the pump, the partition being such that inflammable vapors cannot pass into the upper part to be ignited by any sparks that may occur.

The mount for the fuel-dispensing nozzle of the pump is usually located on the upper part of the casing at a convenient height for grasping by an operator and, since explosive fuel-air mixtures may leak from the nozzle after use, it is necessary to design the mount in such a way that these mixtures cannot penetrate the upper casing. For this purpose it is known to provide a mount which projects laterally from the casing but such mounts are not only expensive but are also aesthetically unpleasing.

The object of the invention is to provide a mount for the nozzle of a liquid-fuel-dispensing pump which prevents the escape of inflammable gases from the nozzle into the upper part of the pump casing, but which is simple and economical to manufacture and can be designed to be aesthetically pleasing.

SUMMARY OF THE INVENTION

According to one aspect of the present invention there is provided a safety mounting device for supporting a fuel-dispensing nozzle which incorporates a support member and defines a fuel-outlet opening on the casing of a liquid-fuel-dispensing pump, comprising a receptacle for said nozzle and mount means for attachment of said receptacle to said casing, wherein said mount means define a space between said receptacle and said casing and vent openings through which said space is vented to the atmosphere to prevent gases from leaking from the receptacle into the casing.

The receptacle for the filling nozzle is preferably of the known type, having a lower part, in use, arranged to receive a support member of the nozzle to support the nozzle in the receptacle and an upper part formed as a pocket to receive and surround the open end of the nozzle. The mount means preferably define a passage and are preferably adapted to be attached to the casing such that, with the receptacle in its correct orientation, the passage is substantially vertical and is open at its upper and lower ends acting as a chimney, an upward draught being induced through the passage in use to carry any explosive gas mixtures which leak into it from the nozzle out into the atmosphere. The mounting device may be formed such that a major portion of the passage is inset into the casing of the fuel pump, in use, and is aesthetically more pleasing than the present, projecting mounts.

The pocket of the nozzle receptacle may project into the passage or a chamber may be provided between the receptacle and the passage into which the pocket projects, a switch for the pump being located in the wall between the pocket and the passage or chamber for activation by the nozzle. The chamber may be closed or vented.

According to a further aspect of the present invention there is provided a casing for a liquid-fuel-dispensing pump having a receptacle for a fuel dispensing nozzle, mounted thereon, wherein mount means support said receptacle on said casing and define a space between said receptacle and said casing and vent openings through which said space is vented to the atmosphere to prevent gases from leaking from the receptacle into the casing.

BRIEF DESCRIPTION OF THE DRAWINGS

Two embodiments of the invention will now be more particularly described, by way of example, with reference to the accompanying, purely diagrammatic drawings, in which.

DESCRIPTION OF THE PREFERRED EMBODIMENTS

Figure 1:
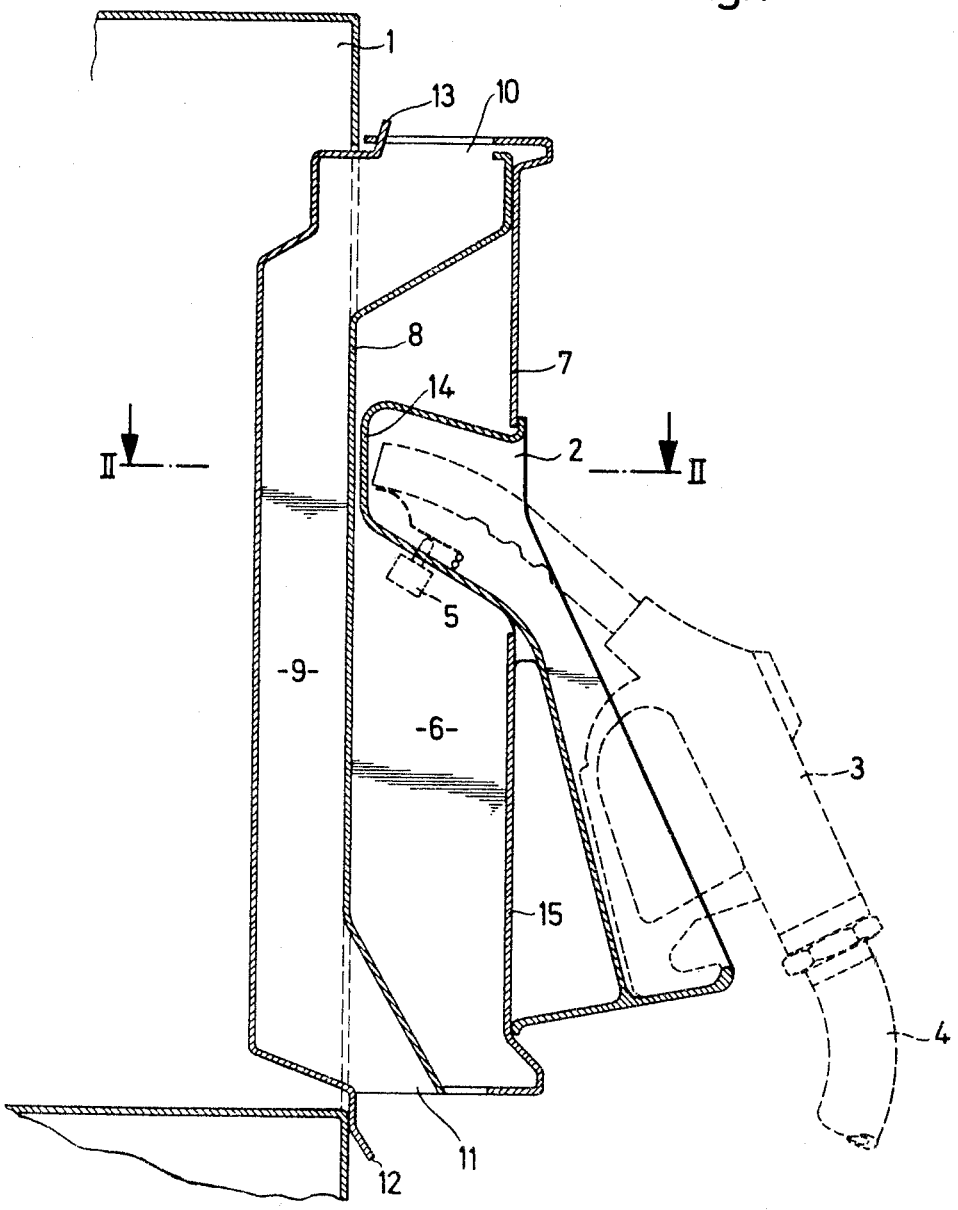
FIG. 1 is a vertical sectional view of part of a casing of a liquid-fuel-dispensing pump provided with a safety mounting device according to one embodiment of the invention.
Figure 2:
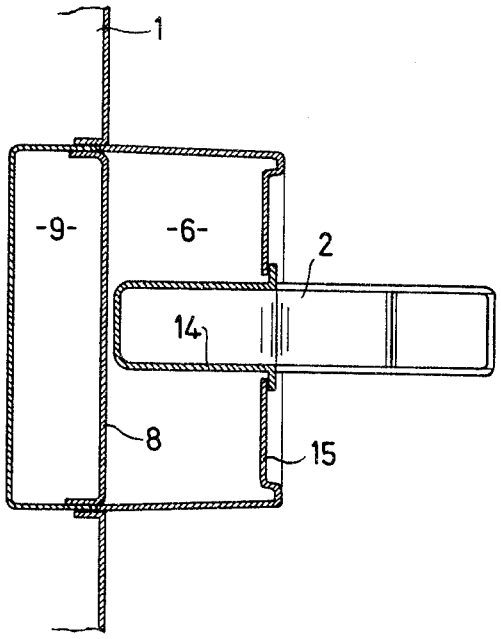
FIG. 2 is a cross-sectional view taken on line II—II of FIG. 1.

Referring to FIGS. 1 and 2 of the drawings, the upper part of a casing 1 of a liquid-fuel-dispensing pump has fitted to it, at a suitable height for use by an operator, a safety mounting device for a fuel dispensing nozzle 3 which is connected to the pump, which is located in the lower part of the casing (not shown), by a hose 4 in the usual way. The mounting device includes a receptacle 2 for the nozzle, having a lower portion adapted to receive a combined trigger guard and support member 14 of the nozzle to support the latter in the receptacle and an upper pocket which receives and surrounds the outlet opening of the nozzle.

The receptacle 2 is mounted on the front wall 7 of a closed chamber 6 of the mounting device which is defined between a plate which forms the front 7 and side walls of the chamber, and a plate 8 which forms rear, upper and lower walls of the chamber. The pocket of the receptacle projects through an aperture in the wall 7 into the chamber 6 and is sealed to the edges of the aperture to close the chamber 6. A lower wall of the pocket which separates the interior of the pocket from the chamber 6 is provided with a switch 5 for the fuel pump which is arranged to be operated by the nozzle: when the nozzle is located in the receptacle it operates the switch 5 to deactivate the pump and cuts off the fuel flow to the nozzle but when the nozzle is withdrawn from the receptacle the switch activates the pump so that fuel can be fed to the nozzle on operation of the trigger switch (not shown) associated with the nozzle and protected by the guard 14.

After the nozzle 3 has been used and has been replaced in the receptacle 2 explosive gases can, in fact still leak from it and penetrate into the chamber 6. Since, apart from the switch 5, the chamber 6 is completely closed, explosive gases cannot normally leak from here into the upper part of the casing 1 of the fuel pump. In order to ensure, however, that these gases cannot penetrate the casing 1, the chamber 6 is not attached directly to the casing 1 but is spaced from it by a vented space 9 formed between the plate 8 which forms the chamber 6 and a panel 15 which is attached to the casing. The space 9 is in the form of a substantially vertical passage, being open at its upper and lower ends 10, 11, respectively such that it acts as a chimney in use, an upward current of air being induced in the passage 9 which carries any gases penetrating it from the chamber 6 out into the atmosphere; explosive gas mixtures from the nozzle 3 are thus prevented from leaking into the casing 1.

In order to maintain a satisfactory airstream through the passage 9, even under cross-wind conditions, the lower opening 11 of the passage 9 is provided with a baffle 12 to deflect the cross winds. The upper opening 10 of the passage 9 is also provided with guide or baffle means 13.

As is shown in the drawings, the panel 15 is sealed to the edges of an aperture in an upper, side wall of the casing 1 and is formed such that the major portion of the passage 9 is located within the casing 1, only the end portions 10, 11 extending outwardly of the casing 1. Only part of the mounting device is thus visible externally of the casing and the device may be made aesthetically more pleasing than known nozzle mounting devices for fuel pumps.

Figure 3:
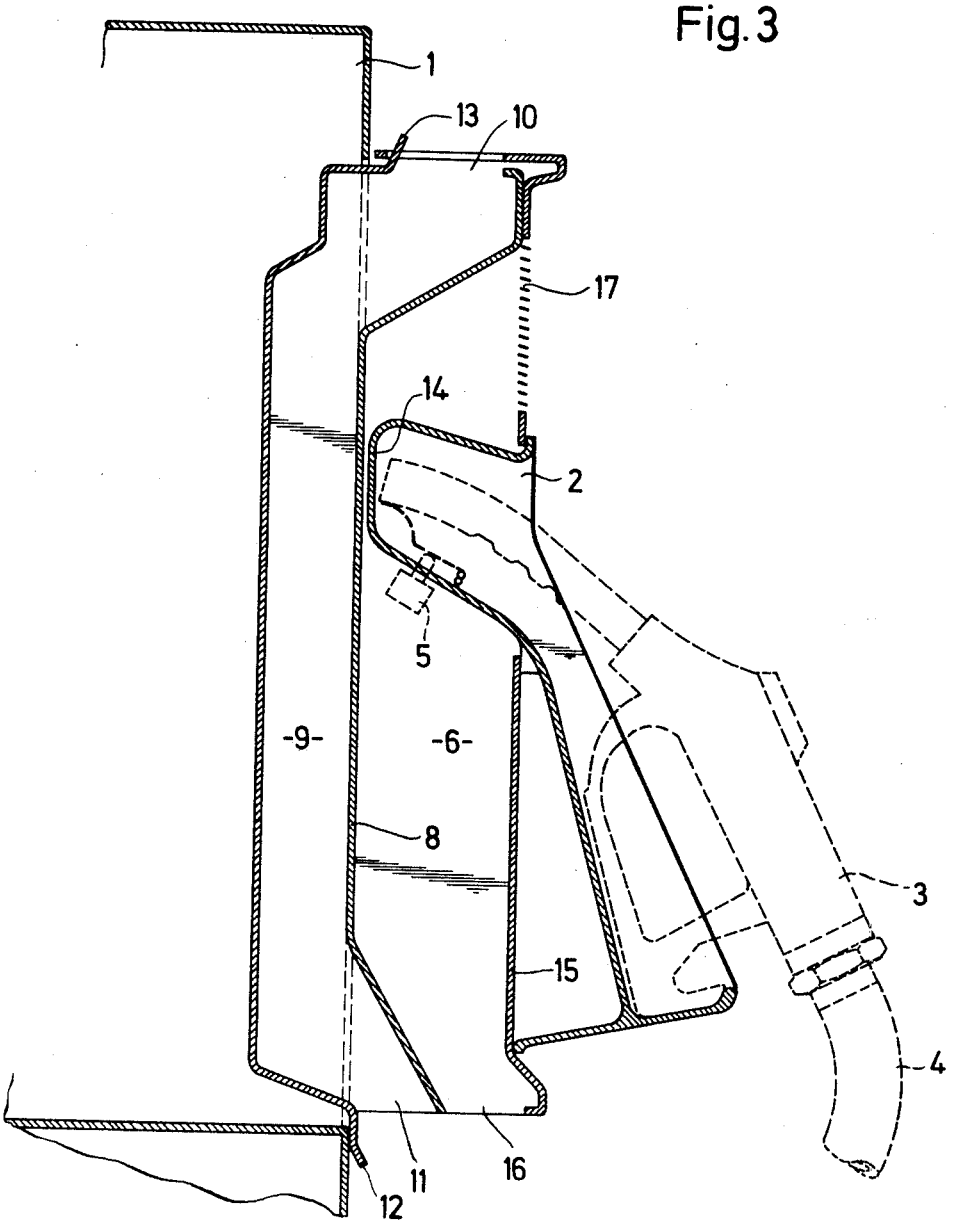
FIG. 3 is a view similar to FIG. 1 showing a second embodiment of the invention.

Referring to FIG. 3 of the drawings, a second embodiment of the invention is shown which in most respects is similar to the device of FIGS. 1 and 2 and similar parts are referenced by the same numerals. In the embodiment of FIG. 3, the chamber 6 is also vented by means of a lower opening 16 and an upper opening 17 such that an upward draught is induced in this chamber, in use, as well as in the passage 9.

What we claim is:

1. A safety mounting device for supporting a fuel-dispensing nozzle, having a support member and a fuel outlet opening, on the casing of a liquid fuel-dispensing pump, comprising:

a nozzle mount housing mountable on the pump casing having generally upstanding, spaced-apart, successively-disposed front, intermediate and rear walls, said front wall and said intermediate wall at least partially defining therebetween a chamber and said intermediate wall and said rear wall at least partially defining therebetween a substantially vertical venting passage having an open, upper and lower end defining vent openings, said front wall having a receptacle defined therein in which said nozzle may be at least partially inserted, and said venting passage acting as a chimney for inducing an upward draft through the passage to carry any explosive gas mixtures which leak from the nozzle into the atmosphere.

2. The safety mounting device according to claim 1, wherein said receptacle has a support portion for receiving said support member of said nozzle and a pocket for receiving and surrounding said fuel-outlet opening.

3. The safety mounting device according to claim 1, wherein said front wall is defined by a first plate which also defines the side walls of said chamber, wherein said intermediate wall is defined by a second plate which also defines the upper and lower walls of said chamber and wherein vent openings are provided in at least one of said walls for venting said chamber.

4. A safety mounting device according to claim 1, wherein at least one of said vent openings is provided with baffle means.

5. A safety mounting devie according to claim 1, wherein said casing has a wall defining an aperture and said housing is adapted for attachment to said casing wall to close said aperture with a major portion of said passage being disposed within the casing and said vent openings being disposed outside of the casing.

6. A casing for a liquid-fuel-dispensing pump comprising:

a pump casing having a nozzle mount housing mounted thereon having generally upstanding, spaced-aparat, successively-disposed front, intermediate and rear walls, said front wall and said intermediate wall at least partially defining therebetween a chamber, and said intermediate wall and said rear wall at least partially defining therebetween a substantially vertical venting passage having an open, upper and lower end defining vent openings, said front wall having a receptacle defined therein in which said nozzle may be at least partially inserted, and said venting passage acting as a chimney for inducing an upward draft through the passage to carry any explosive gas mixtures which leak from the nozzle into the atmosphere.

7. The casing according to claim 6, wherein said casing has a generally vertical wall having an aperture formed therein and wherein said housing is at least partially received in said aperture and is configured such that a major portion of said venting passage lies within said casing while said vent openings lie outside said casing.

* * * * *